US010889020B2

(12) United States Patent
Greenleaf

(10) Patent No.: US 10,889,020 B2
(45) Date of Patent: Jan. 12, 2021

(54) DUAL FLEXGRIP ARRANGEMENT

(71) Applicant: Richard J. Greenleaf, Manchester, MA (US)

(72) Inventor: Richard J. Greenleaf, Manchester, MA (US)

( * ) Notice: Subject to any disclaimer, the term of this patent is extended or adjusted under 35 U.S.C. 154(b) by 0 days.

(21) Appl. No.: 16/873,258

(22) Filed: Mar. 5, 2020

(65) Prior Publication Data

US 2020/0238361 A1 Jul. 30, 2020

Related U.S. Application Data

(63) Continuation-in-part of application No. 16/602,167, filed on Aug. 20, 2019, which is a continuation-in-part of application No. 16/501,026, filed on Feb. 11, 2019, now Pat. No. 10,807,269, which is a continuation-in-part of application No. 15/530,236, filed on Dec. 14, 2016, now Pat. No. 10,201,906.

(51) Int. Cl.

| | |
|---|---|
| ***B26F 1/14*** | (2006.01) |
| ***B21D 37/04*** | (2006.01) |
| ***B21D 28/26*** | (2006.01) |

(52) U.S. Cl.

CPC ..... *B26F 1/14* (2013.01); *B21D 28/26* (2013.01); *B21D 37/04* (2013.01)

(58) Field of Classification Search

CPC ..... B21D 28/34; B21D 37/04; B21D 28/26; B26D 7/2628; B26F 1/14

USPC ..... 409/309

See application file for complete search history.

(56) References Cited

U.S. PATENT DOCUMENTS 126,183 A * 4/1872 Charlton ..... A47B 91/024 403/309
3,244,489 A * 4/1966 Parker ..... B21D 28/34 29/445

(Continued)

FOREIGN PATENT DOCUMENTS

CA 2535296 A1 * 2/2005
CH 667501 A5 * 10/1988 ..... F16B 39/36

(Continued)

OTHER PUBLICATIONS

English Translation CH667501. (Year: 1988).*
English Translation DE20007342 U1. (Year: 2001).*

*Primary Examiner* — Jennifer B Swinney
(74) *Attorney, Agent, or Firm* — Don Halgren

(57) ABSTRACT

An arrangement for adjustably enabling the holding of a tool in a tool holder plate for punch press machine. The tool holding arrangement comprises a tool holder plate having a size adjustable tool gripper opening therein. An adjustment bolt bore is arranged adjacent the size adjustable tool gripper opening wherein the adjustment bolt bore has an upper end of conical shape and a lower end opening of pyramidal shape with trapezoidally shaped walls. An expandable adjustment gap is arranged between the size adjustable tool gripper opening and the adjustment bolt bore. A pair of flexure slots are arranged in the tool holder plate, to define a pair of flexible gripper claws therebetween. Changes in the adjustment gap by adjustment of the bolt in the bolt bore enhances the evenly opened size of the tool gripper opening to permit the tool to be properly installed therein.

12 Claims, 5 Drawing Sheets

(56) References Cited

U.S. PATENT DOCUMENTS

| | | | | |
|---|---|---|---|---|
| 4,620,814 | A * | 11/1986 | May | F16D 1/087 403/314 |
| 2012/0263556 | A1* | 10/2012 | Pratt | F16B 19/1054 411/361 |
| 2017/0167526 | A1* | 6/2017 | Hasegawa | F16B 39/028 |
| 2020/0116183 | A1* | 4/2020 | Hirose | F16B 12/48 |

FOREIGN PATENT DOCUMENTS

| | | | | |
|---|---|---|---|---|
| DE | 3243254 | A1 * | 5/1984 | F16B 13/141 |
| DE | 20007342 | U1 * | 2/2001 | |

* cited by examiner

DUAL FLEXGRIP ARRANGEMENT

The present invention relates to securement and alignment arrangements and more particularly to insertable fastener or securement members for holding multiple rigid plates together in secure and accurate alignment, such as for example holding plates together securely and accurately in a compound tooling punch press machine assembly as represented in my application Ser. No. 15/731,317, now U.S. Pat. No. 10,384,257, issued 20 Aug. 2019, incorporated herein by reference, and more specifically to gripping plates for securely holding and aligning die members within that gripping plate, and is a continuation-in-part application of application Ser. No. 16/602,167, which is a continuation-in-part application of application Ser. No. 16/501,026, filed Feb. 11, 2019 which is a continuation-in-part application of application Ser. No. 15/530,236, filed Dec. 14, 2016, now U.S. Pat. No. 10,201,906, each of which are incorporated herein by reference.

BACKGROUND OF THE INVENTION

Field of the Invention and Discussion of the Prior Art

Compound tooling is currently utilized by hundreds of manufacturers to produce thousands of different types of washers made from aluminum, brass, copper, nylon, steel utilized in almost everything society touches. Washers are for example, utilized in any product with nuts and bolts or moving parts. The inside diameter and the outside diameter of these washers or other punched parts have become more critical and significant for use in the manufacture of high-quality precision devices.

Prior art tool and die sets have to be made slightly loose, and those tools use clamping screws which thus influences a die in a tool holder. That in turn establishes inaccuracies and a loss of concentricity of the alignment of those tools. Recent advances have been improved upon by the present invention which allows adjustment and assembly of multiple gripping arrangements in a single gripping or die holder plate. However, holding of a die holder plate to an ID punch holder plate in the prior art requires multiple screw thread members together with multiple dowels to align and assemble these pieces in an extensive and inefficient manner.

It is thus an object of the present invention to overcome the disadvantages of the prior art.

It is a further object of the present invention to provide an assembly member in which a first plate, or for example, an ID punch holder plate for a punch press and a second plate, or for example, a compound punch holder plate for a punch press, are assembled in simplified, quickly secured alignment with one another.

BRIEF SUMMARY OF THE INVENTION

The present invention comprises an elongated assembly securement member for quickly and easily joining in proper alignment two plate members, for example, as those required in a punch press machine. Such a machine of necessity needs a quick tool change arrangement. A reciprocally movable upper support member is arranged on a punch press frame. The system also includes a lower support member arranged on the punch press frame. A pair of tool gripping members are arranged on the upper support member and a pair of tool gripping members are also arranged on the lower support member. For our purposes here, only the tool gripping members for the lower support member will be discussed. The tool gripping members in this instance are a die holder plate and a punch holder plate, both being critically required to be in proper alignment with one another for the parts-punching operation to properly proceed. The die holder plate and the punch holder plate are preferably identical to one another wherein one central tool gripper opening in one plate holds a die and one central opening in the other plate holds a punch.

The plates in this particular assembly are of rectilinear configuration having one or more central openings for the punch press operation to take place. The first plate is an upper or die holder plate to be secured together in close alignment with a lower or second immediately adjacent punch holder plate. The first or upper plate preferably has a plurality of tapered (connectivity) openings and the second or lower plate has a corresponding plurality of (connectivity) bores, a lower portion of which are threaded. Otherwise, these matable plates are identical to one another excepting for their connectivity openings.

The respective (connectivity) openings in the upper or die holder plate and the lower or punch holder plate comprising the joined assembly have correspondingly tapered and threaded holes respectively so as to permit a snug screwed-in wedging arrangement between the elongated securement member and their respective plates which are secured thereby, as specified in my earlier co-pending patent application referenced hereinabove.

The holder plates may have one or more tool gripper opening arrangements distributed across their surface. The attached holder plates also require their tool gripper opening arrangements to be in extremely close longitudinal alignment with one another when those holder plates are attached to one another.

Each tool gripper opening arrangement comprises a tool gripper opening, an adjustable bolt bore, a non-linear flexure slot extending from opposed sides respectively of the adjustable bolt bore to a location outwardly adjacent the tool gripper opening, and an adjustment-gap-slot extending between the perimeter of the tool gripper opening and the perimeter of the adjustable bolt bore at their closest locations to one another.

A flexible gripper claw is thus respectively arranged between each flexure slot, and it's respective side of the adjustment bolt bore, it's respective side of the adjustment gap and the respective side of the perimeter of the tool gripper opening so as to provide an adjustable tool gripper opening facilitated by an adjustable bolt arranged within the adjustable bolt bore.

The adjustable bolt bore has an upper half end which is conically shaped and tapered at an angle of about 10° with respect to the longitudinal axis of the bolt bore. The adjustable bolt bore has a lower half end which has an opening of preferably square shape with tapered walls to define a generally pyramidically shaped opening. Each of the walls of the pyramidically shaped opening are of truncated or trapezoidal shape and are arranged at an angle of about 10° with respect to the longitudinal axis of the adjustable bolt bore.

The upper half end of the adjustable bolt has a conically shaped upper end with its sloped side arranged at an angle of about 10 degrees with respect to the longitudinal axis of the adjustable bolt bore, and an elongated threaded distal or lower end. The head of the upper end of the adjustable bolt has a wrench receiving bore therewithin so as to enable rotational adjustment of the adjustment bolt.

The threaded lower half end of the adjustable bolt bore is arranged to receive a truncated pyramidically shaped nut having walls which are tapered to about 10° with respect to its longitudinal axis. The truncated pyramidically shaped nut has a threaded internal bore arranged to receive the elongated threaded distal or lower end of the adjustment bolt.

Rotational adjustment of the adjustment bolt within the adjustment bolt bore during its engagement with the truncated nut at the lowermost end of the adjustment bolt bore effects flexural displacement of the flexible gripper claws so as to spread the flexible gripper claws apart and evenly widening the adjustment gap between the two by virtue of the cone and the nut both spreading the plate gripper claws apart without twisting or unevenly torqueing the tool holder plate, thus evenly expanding the diameter of the tool gripper opening to permit insertion of a tool therewithin. The location of the flexure joint of each flexible gripper claw is at the bridge of the distalmost end of the flexure slot and its adjacent wall portion of the tool gripper opening. The distal end of each flexure slot for each flexible gripper claw is arranged at a locus of the diameter of the tool gripper opening between those two flexure slots. That diameter extends across the center of the tool gripper opening.

The invention thus comprises a tool holder plate arrangement for adjustably securing one or more tools with respect to a second tool holder plate, comprising: a tool gripper arrangement for holding each tool, the tool gripper arrangement including tool gripper opening in the tool holder plate, an adjustment bolt bore adjacent the tool gripper opening with an adjustment gap therebetween, a non-linear flexure slot arrangement having a proximal end extending between opposed sides of the adjustment bolt bore, wherein each nonlinear flexure slot arrangement has a distal end extending to opposed sides of the diameter of the tool gripper opening and spaced apart therefrom; an adjustment bolt arranged within the adjustment bolt bore having a lower end engaged with a truncated pyramidically shaped nut, wherein adjustment of the adjustment bolt changes the size of the adjustment gap between the flexible gripper claws. The adjustment bolt bore has a lower end with a square opening with a plurality of flat truncated, tapered walls defining that opening thereat. The adjustment bolt bore has an upper end with tapered walls of conical shape. The adjustment bolt as an upper and with a wrench receiving bore therein to permit the adjustment bolt to be turned within the adjustment bolt bore. The conical shape is tapered at an angle of about 10° with respect to the longitudinal axis of the adjustment bolt. The tool is selected from the group consisting of a die or a punch.

The invention also comprises a method of gripping a tool within a tool holder plate for use in a punch press machine, comprising the steps of: arranging a tool gripper opening in a tool holder plate; forming an adjustment bolt bore in the tool holder plate adjacent the tool gripper opening; machining a nonlinear flexure slot between a side of the adjustment bolt bore and a location adjacent the tool gripper opening to form a first biasable flexible gripper claw; inserting an adjustment bolt within the adjustment bolt bore, the adjustment bolt having its lower end received within a truncated nut at a truncated side arrangement at the lower end of the adjustment bolt bore within the tool holder plate; and inserting a tool within the tool gripper opening. The method may include the steps of turning the adjustment bolt in the adjustment bolt bore so as to engage the sides of the adjustment bolt and the sides of the truncated nut with the truncated sides of the adjustment bolt bore; including a second biasable flexible gripper claw in opposed juxtaposition to the first biasable flexible gripper claw.

The invention also includes an arrangement for adjustably enabling the holding of a tool in a tool holder plate for punch press machine, comprising: a tool holder plate having a size adjustable tool gripper opening therein; an adjustment bolt bore arranged adjacent the size adjustable tool gripper opening, wherein the adjustment bolt bore has an upper end of conical shape and a lower end opening of pyramidal shape with trapezoidally shaped walls; an expandable adjustment gap arranged between the size adjustable tool gripper opening and the adjustment bolt bore; a pair of flexure slots in the tool holder plate, the flexure slots having a first end extending from a location diametrically opposed from one another and adjacent the tool gripper opening to a second location opening in the adjustment bolt bore, wherein portions of the tool gripper opening, the adjustment gap, the adjustment bolt bore and the flexure slots define a pair of flexible gripper claws therebetween. An elongated adjustment bolt has an upper or first end of conical shape and second or lower end having a threaded end. A pyramidally shaped nut is included having a threaded bore therethrough, and with trapezoidally shaped walls having a truncated upper end for with a threaded bore therethrough for threaded receipt of the second or lower end of the elongated adjustment bolt. Tightening adjustment of the elongated adjustment bolt effects a biasing apart of the adjustment gap to enable a tool to be inserted into an evenly-expanded tool gripper opening. The flexure of slots are preferably non-linear. The upper end of the adjustment bolt bore is sloped at an angle of about 10° with respect to the longitudinal axis of the adjustment bolt bore. The lower end opening of the adjustment bolt bore is defined by trapezoidally shaped walls arranged to slidably engage the trapezoidally shaped walls of the nut.

BRIEF DESCRIPTION OF THE DRAWINGS

The objects and advantages of the present invention will become more apparent, when viewed in conjunction with the following drawings, in which.

DETAILED DESCRIPTION OF THE DRAWINGS

Figure 1:
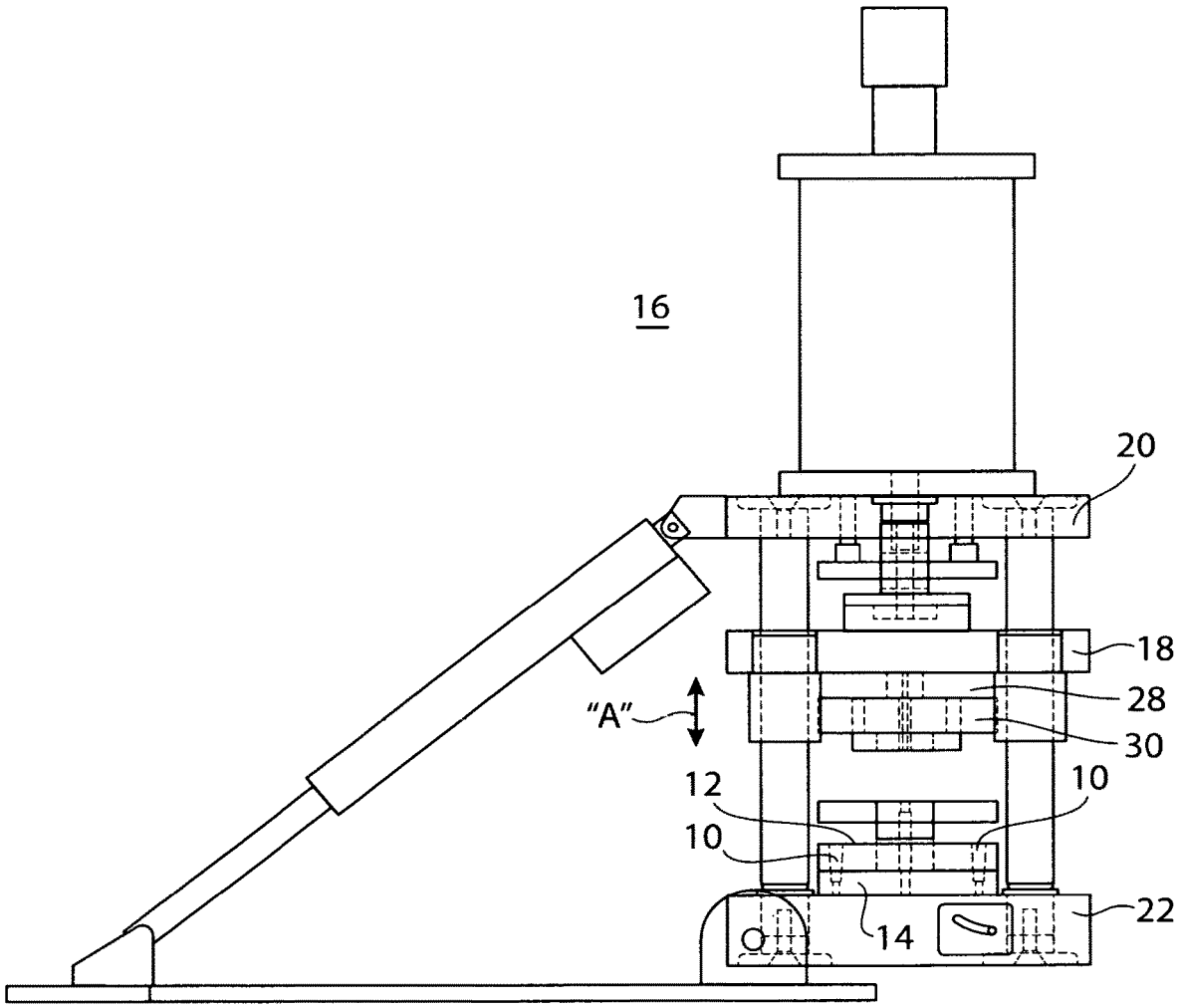
FIG. 1 is a side elevational view of a punch press apparatus showing in an edge view with several holder plates which utilize the present fastener invention.

Referring now to the drawings in detail and particularly to FIG. 1 there is shown the present invention in use, which invention comprises an elongated assembly securement member 10 for quickly and easily joining into proper alignment two plate members 12 and 14, for example, such as those required in a punch press machine 16. Such a machine 16 of necessity needs a quick tool change arrangement facilitated by changing these tool carrying plate members (upper) 12 and (lower) 14, which are utilized as discussed hereinbelow.

A reciprocally movable (as represented by arrow "A") upper support member 18 is arranged on a system comprising here, a punch press frame 20. This system also includes a lower support member 22 arranged on the punch press frame 20. A pair of tool gripping plates may be arranged on the upper support member 18 and a pair of tool gripping members or plates 28 and 30 are also arranged on the lower support member 22. For our purposes here, only the tool gripping member arrangement (plates 12 and 14) for the lower support member 22 will be discussed, as further represented in FIGS. 2 and 3. The tool gripping members 12 and 14 in this instance are an (upper) die holder plate 12 and a (lower) punch holder plate 14, both being critically required to be in proper alignment with one another, as represented in my U.S. Pat. Nos. 8,925,435, and 9,561,534, both incorporated herein by reference.

Figure 2:
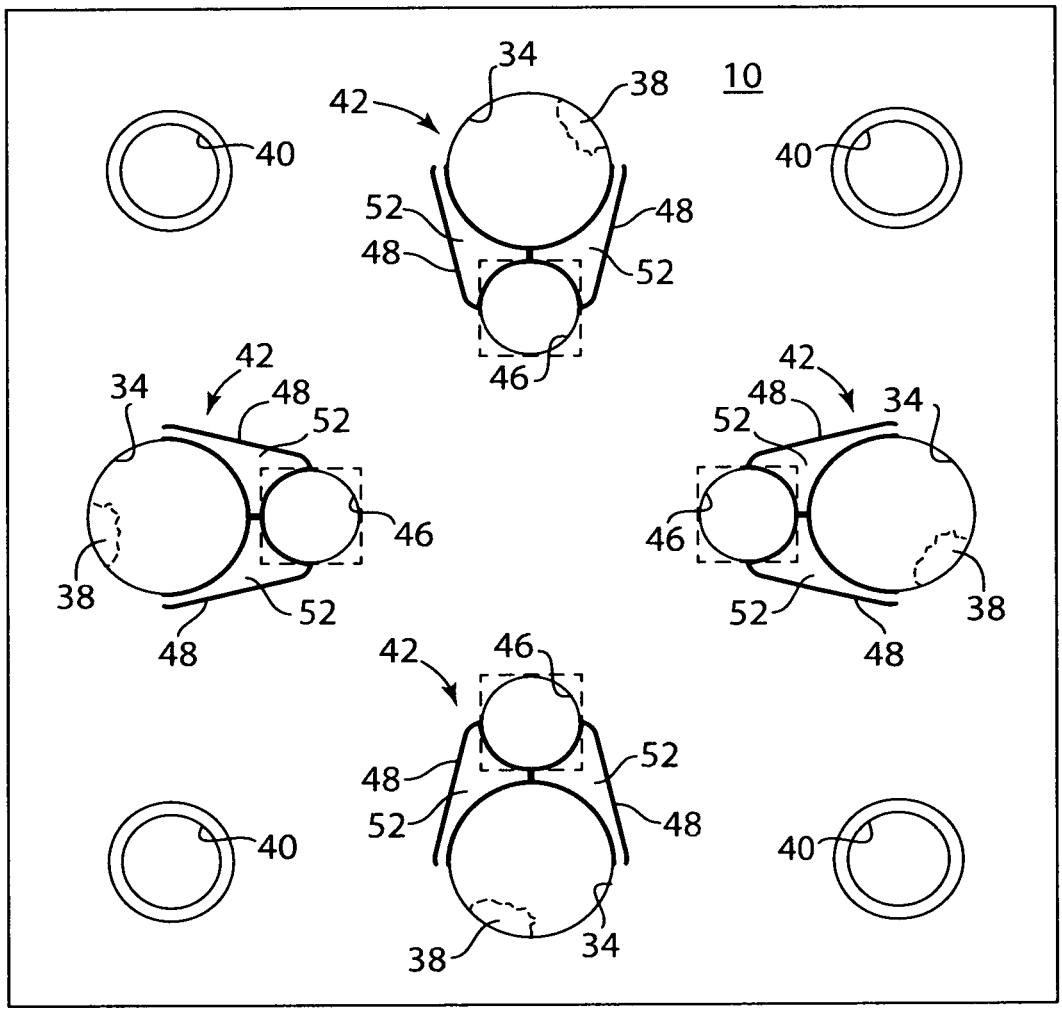
FIG. 2 is a plan view of a die holder plate which was shown in an edge view in FIG. 1 indicating where the present fastener invention is utilized.

The (upper and lower) plates 10 and 14 in this particular assembly are of rectilinear configuration, as may be seen by plate 10 in FIG. 2, may have one or more central punch-tool-accommodating openings 34, for the punch press operation to take place. The first plate is an upper or die holder plate 12 to be secured in close tool-hole alignment with a lower or second, immediately adjacent punch holder plate 14, as may be seen in FIG. 1. The first or upper plate 10 has a plurality of bores 40, for accurately aligning the paired plates 10 and 14 as identified in my earlier cited applications and patents. Such a punch press machine 16, of necessity needs a quick tool change arrangement. For our purposes here, only the tool gripping member plate 10 for the lower support member will be discussed. Since the tool gripping plates 10 and 14 are similar, only tool gripping plate 10 will be identified/discussed. Typically the tool gripping member plates 10 and 14 in this instance are a die holder plate and a punch holder plate respectively, both being critically required to be in proper alignment with one another for the parts-punching operation to properly proceed. The die holder plate 10 and the punch holder plate 14 are preferably identical to one another wherein one central tool gripper opening 34 in one plate holds a die 38 and one central opening in the other plate (not shown) holds a punch.

The plates in this particular assembly are of rectilinear configuration having a plurality of central openings 34 for the punch press operation to take place as is shown in FIG. 2. The first plate is an upper or die holder plate to be secured, together in close alignment with a lower or second immediately adjacent punch holder plate. The first or upper plate (10) preferably has a plurality of tapered (connectivity) openings 40 and the second or lower plate (14) has a corresponding plurality of (connectivity) bores 40, a lower portion of which are threaded. Otherwise, these matable plates are identical to one another excepting for their connectivity openings/bores 40.

The respective (connectivity) openings 40 in the upper or die holder plate 10 and the lower or punch holder plate 14 comprising the joined assembly have correspondingly tapered and threaded holes respectively so as to permit a snug screwed-in wedging arrangement between the elongated securement member and their respective plates which are secured thereby, as specified in my earlier co-pending patent application referenced hereinabove.

The holder plates 10 and 14 may have one or more tool gripper opening arrangements 42 distributed across their surface, for holding either a die or a punch 38 respectively, as shown in FIG. 2. The attached holder plates 10 and 14 also require their tool gripper opening arrangements 42 to be in longitudinal alignment with one another when those holder plates 10 and 14 are attached to one another.

Figure 3:
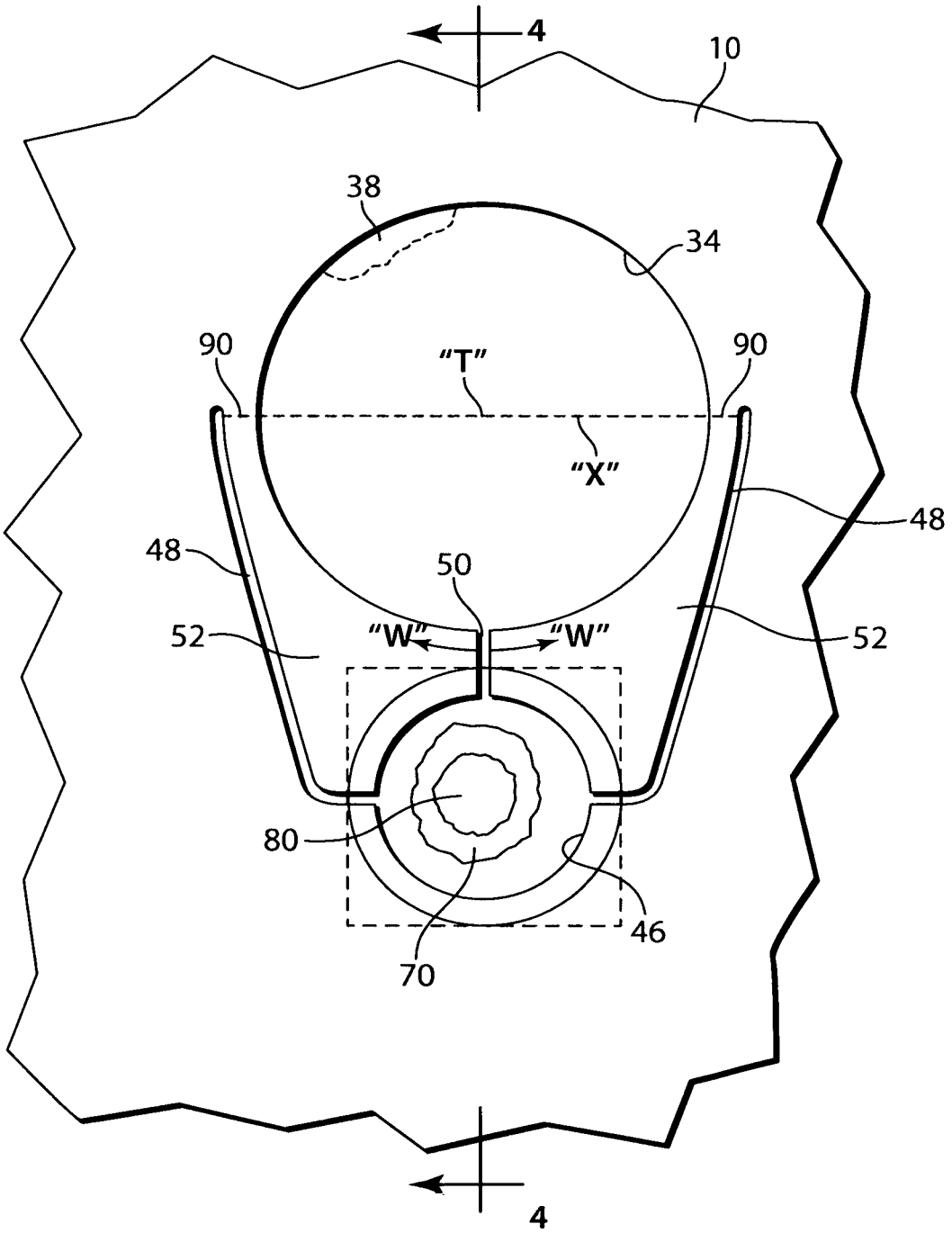
FIG. 3 is an enlarged plan view of a flexible tool gripping arrangement opening on a die or punch holder plate shown in an edge view in FIG. 1 indicating where the present fastener invention is utilized.

As may be seen in FIG. 3, each tool gripper opening arrangement 42 comprises the tool gripper opening 34, an adjustable bolt bore 46, a non-linear flexure slot 48 extending from (each) diametrically opposed side(s) respectively of the adjustable bolt bore 46 to a diametrically opposed location outwardly adjacent the tool gripper opening 34, and an adjustment-gap-slot 50 extending between the perimeter of the tool gripper opening 34 and the perimeter of the adjustable bolt bore 46 at their closest location to one another.

Flexible gripper claws 52, as shown in FIG. 3, are thus respectively arranged between each flexure slot 48, and it's respective side of the adjustment bolt bore 46, it's respective side of the adjustment gap 50 and the respective side of the perimeter of the tool gripper opening 34 so as to provide an adjustable tool gripper opening 34 for holding a tool 38, which gripper opening 34 has an adjustment bolt 70 for enabling the altering of the adjustment gap 50, which adjustment is facilitated by movement of the conically shaped upper end of the adjustable bolt 70 arranged within the conically shaped upper end of the adjustable bolt bore 46 and an engaged nut 80 at the lower end of the bolt bore 46. The bolt 70 having an conically shaped upper end 72, tapered at an angle "B" of about 10 degrees to correspond to the conically shaped upper end of the adjustable bolt bore 46.

Figure 4:
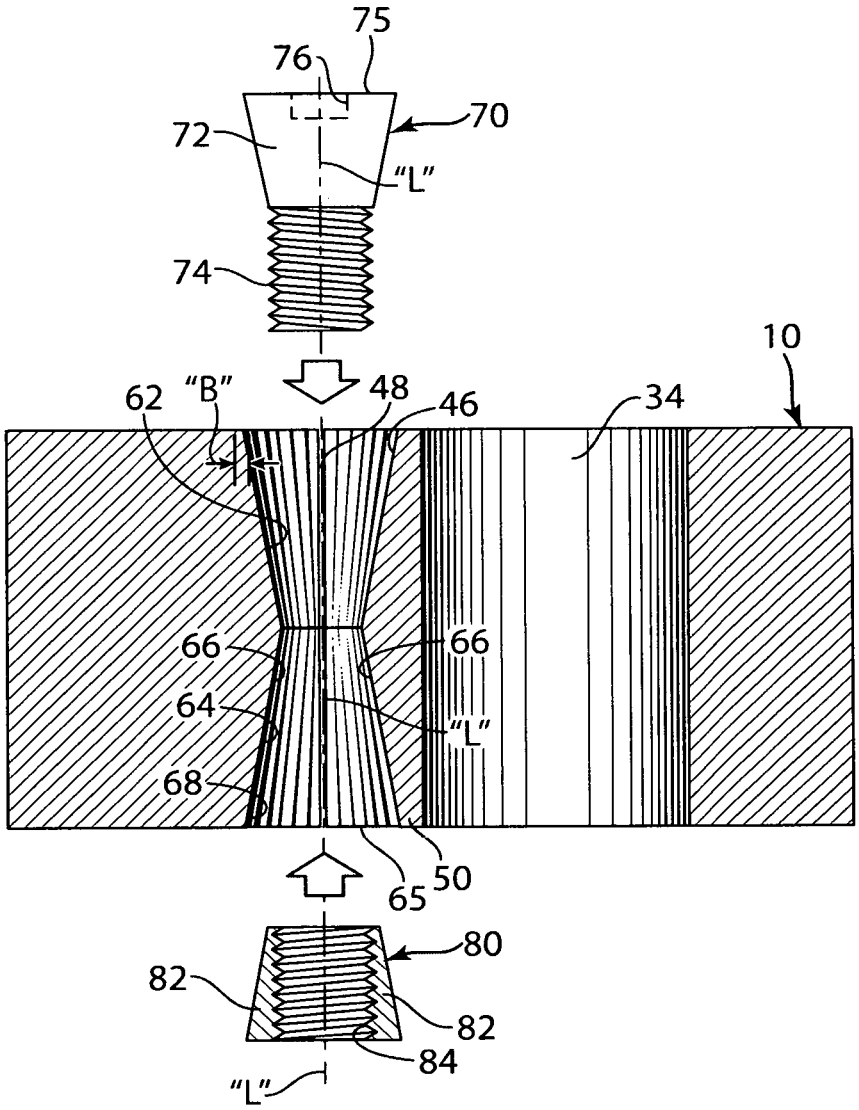
FIG. 4 is an exploded sectional view of the flexible tool gripping arrangement as shown in FIG. 3, also including its required bolt and engagement nut.
Figure 5A:
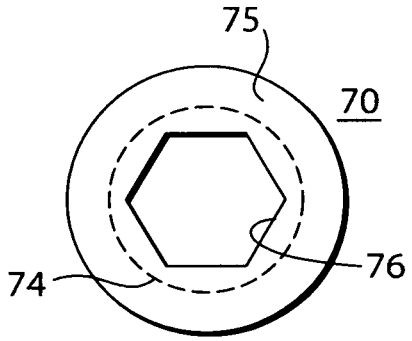
FIG. 5A is a top end view of an adjustable bolt utilized in the flexible tool gripping arrangement shown in FIG. 4.
Figure 5B:
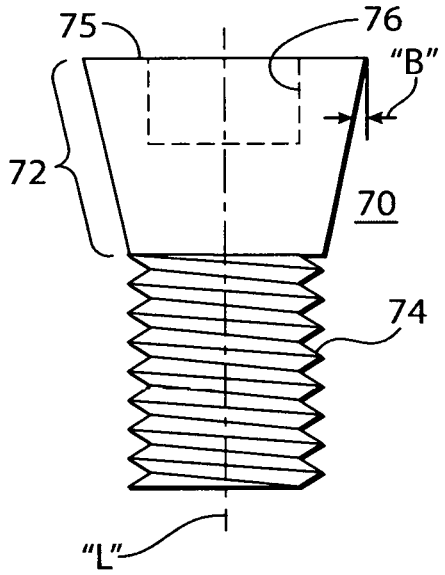
FIG. 5B is a side elevational view of the bolt shown in FIG. 4.

The adjustable bolt bore 46 shown in FIGS. 4 and 5A and 5B, has an upper half end 62 which is conically shaped and tapered at an angle "B" of about 10° with respect to the longitudinal axis "L" of the bolt bore 46. The adjustable bolt bore 46 has a lower half end 64 which has a lower opening 65 of preferably square shape with flat tapered walls 66 to define a generally pyramidically shaped nut-receiving-space 68. Each of the walls 66 of the pyramidically shaped nut-receiving-space 68 are of truncated trapezoidal shape and are arranged at an angle of about 10° with respect to the longitudinal axis "L" of the adjustable bolt bore 46.

The upper end 62 of the adjustable bolt bore 46 is of conical shape with a sloped side arranged at an angle of about 10° with respect to the longitudinal axis "L" of the adjustment bolt bore 46 and to the elongated threaded or distal lower end 74. The head 75 of the upper end of the adjustable bolt 70 has a wrench receiving bore 76 shown in FIGS. 4, 5A and 5B, therewithin, so as to enable receipt of and rotational adjustment of the adjustment bolt 76 by an Allen wrench or the like.

Figure 6A:
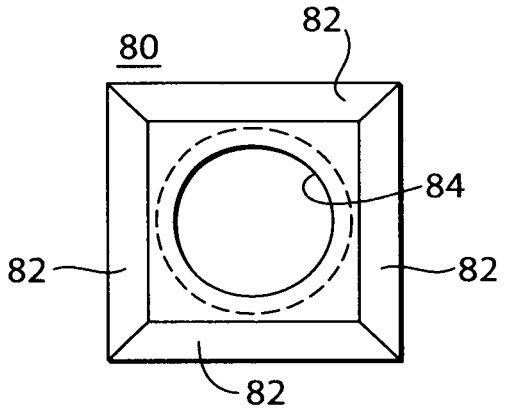
FIG. 6A is a top end view of a shaped nut utilized with the bolt shown in FIG. 4.
Figure 6B:
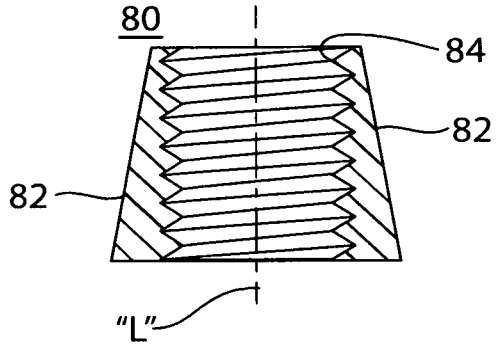
FIG. 6B is a side view of the shaped nut shown in FIG. 4.

The lower half end 64 of the adjustable bolt bore 46, best shown in FIG. 4, is arranged to receive a truncated pyramidically-shaped nut 80 having four flat, trapezoidally shaped walls 82 each of which are tapered to about 10° with respect to its longitudinal axis "L" as represented in FIG. 4 and FIGS. 6A and 6B. The truncated pyramidically-shaped nut 80 has a threaded internal bore 84 arranged to receive the elongated threaded distal or lower end of the adjustable bolt 70.

Rotational adjustment of the adjustment bolt 70 within the adjustment bolt bore 62 during its engagement with the truncated nut 80 at the lowermost end of the adjustment bolt bore 46 effects non-torqued flexural displacement of the flexible gripper claws 52 so as to evenly spread the flexible gripper claws 52 apart as indicated by the arrows "W" FIG. 3, and widening the adjustment gap 50 between the two claws 52, thus expanding the diameter of the tool gripper opening 34 to permit properly aligned insertion/removal of a tool 38 therewithin. The location of the flexure joint 90 of each flexible gripper claw 52 is at the diametrically located bridge between the distalmost end of the flexure slot 48 and its adjacent wall portion of the tool gripper opening 34 as may be seen in FIG. 3. The distal end of each flexure slot 48 for each flexible gripper claw 52 is arranged at a locus of the diameter "X" of the tool gripper opening between those two flexure slots 48 and 48. That diameter "X" extends across the center "T" of the tool gripper opening 34, as may be seen in FIG. 3.

Thus, a flexible claw arrangement is shown changing size gripper opening made tool holder plate utilization in a punch press machine. The conically shaped upper end of the adjustable bolt 70 in combination with the truncated pyramidally shaped adjustment nut 80 mated thereon provides simultaneous bias against the correspondingly sloped surfaces of both ends of the bolt bore 46 to evenly bias the flexible gripper claws 52 open, and thus change the split of its adjustment gap 50 therebetween and hence the tool receiving opening 34.

The invention claimed is:

1. A tool holder plate arrangement for adjustably securing one or more tools with respect to a second tool holder plate, comprising:

a tool gripper arrangement for holding each tool, the tool gripper arrangement including tool gripper opening in the tool holder plate, a single adjustment bolt bore adjacent the tool gripper opening with an adjustment gap therebetween, the single adjustment bolt bore arranged in alignment with the adjustment gap and between a pair of gripper claws;

a non-linear flexure slot arrangement having a proximal end extending between diametrically opposed sides of the adjustment bolt bore, wherein a nonlinear flexure slot arrangement has a distal end extending to diametrically opposed sides of the diameter of the tool gripper opening and spaced apart therefrom, each flexure slot, the single adjustment bolt bore and the tool gripper opening each having wall portions defining a portion of the gripper claw;

a single adjustment bolt having a longitudinal axis, the adjustment bolt arranged within the single adjustment bolt bore having a lower end engaged with a nut, wherein adjustment of the single adjustment bolt changes the size of the adjustment gap between the flexible gripper claws.

2. The tool holder plate arrangement as recited in claim 1, wherein the adjustment bolt bore has a lower end with a square opening thereat and wherein the nut is truncated.

3. The tool holder plate arrangement as recited in claim 2, wherein the adjustment bolt bore has an upper end with tapered walls of conical shape.

4. The tool holder plate arrangement as recited in claim 3, wherein the conical shape is tapered at an angle of about 10° with respect to the longitudinal axis of the adjustment bolt.

5. The tool holder plate arrangement as recited in claim 2, wherein the adjustment bolt has an upper end with a wrench receiving bore therein to permit the adjustment bolt to be turned within the adjustment bolt bore.

6. A single bolt adjustment arrangement for adjustably enabling the aligned holding of a tool in a tool holder plate for punch press machine, comprising:

a tool holder plate having a size adjustable tool gripper opening therein;

a single adjustment bolt bore having a longitudinal axis, the single adjustment bolt bore also arranged adjacent the size adjustable tool gripper opening, wherein the single adjustment bolt bore has an upper end of conical shape and a lower end opening of truncated pyramidal shape comprised of four trapezoidally shaped walls;

an expandable adjustment gap arranged in alignment between the size adjustable tool gripper opening and the single adjustment bolt bore;

a pair of flexure slots in the tool holder plate, the flexure slots having a first end extending from a location diametrically opposed from one another and adjacent the tool gripper opening to a second location opening at the adjustment bolt bore, wherein portions of the tool gripper opening, the adjustment gap, the single adjustment bolt bore and the flexure slots define a pair of flexible gripper claws therebetween, to enable alignment of a tool in the gripper opening by adjustment of a single bolt.

7. The arrangement as recited in claim 6 for adjustably holding a tool in a tool holder plate, including a single elongated adjustment bolt having a longitudinal axis, the adjustment bolt also having an upper or first end of conical shape and second or lower end having a threaded end.

8. The arrangement as recited in claim 7 for adjustably holding a tool in a tool holder plate, including a truncated pyramidally shaped nut having a threaded bore therethrough, and with trapezoidally shaped walls having a truncated upper end for threaded receipt of the second or lower end of the elongated adjustment bolt.

9. The arrangement as recited in claim 8, wherein tightening adjustment of the elongated adjustment bolt effects a biasing apart of the adjustment gap to enable a tool to be inserted into an evenly-expanded tool gripper opening.

10. The arrangement as recited in claim 9, wherein the flexure of slots are non-linear.

11. The arrangement as recited in claim 10, wherein the upper end of the single adjustment bolt bore is sloped at an angle of about 10° with respect to the longitudinal axis of the adjustment bolt bore.

12. The arrangement as recited in claim 11, wherein the lower end opening of the adjustment bolt bore is defined by trapezoidally shaped walls arranged to slidably engage the trapezoidally shaped walls of the nut.

* * * * *